United States Patent [19]

Evans

[11] Patent Number: 4,601,333

[45] Date of Patent: Jul. 22, 1986

[54] THERMAL SLIDE JOINT

[75] Inventor: Robert W. Evans, Huntsville, Tex.

[73] Assignee: Hughes Tool Company, Houston, Tex.

[21] Appl. No.: 728,018

[22] Filed: Apr. 29, 1985

[51] Int. Cl.[4] ..... E21B 33/128

[52] U.S. Cl. ..... 166/115; 166/387; 166/139; 166/237; 285/139

[58] Field of Search ..... 166/387, 116, 139, 237, 166/115; 285/139, 338, 346, 392, DIG. 14

[56] References Cited

U.S. PATENT DOCUMENTS

| | | | |
|---|---|---|---|
| 2,899,218 | 8/1959 | Creighton | 285/302 |
| 3,260,310 | 7/1966 | Brown | 166/139 |
| 3,283,821 | 11/1966 | Brown | 166/139 |
| 3,289,766 | 12/1966 | Bigelow | 166/139 |
| 3,433,506 | 3/1969 | Crowe | 285/187 |
| 3,504,936 | 4/1970 | Brown et al. | 285/106 |
| 4,281,858 | 8/1981 | Bowyer | 285/39 |
| 4,423,889 | 1/1984 | Weise | 285/39 |
| 4,433,725 | 2/1984 | Bowyer | 166/381 |

*Primary Examiner*—James A. Leppink

*Assistant Examiner*—Terry Lee Melius

*Attorney, Agent, or Firm*—Charles D. Gunter, Jr.

[57] ABSTRACT

A slide joint is shown which is used to provide a floating seal between an inner floating member and a surrounding conduit in a well bore. The floating member has a clutch element which is engaged at one end thereof. A circumferential, compressible packing is carried on the exterior of the floating member and is sandwiched between a fixed nut, at one end, and the clutch element at the other end. The clutch element includes downwardly extending clutch portions which are engageable with mating recesses provided within the inner bore of the surrounding well conduit when the floating member is run into position. The floating member can then be rotated by rotating the associated tubing string which extends to the well surface. As the floating member is rotated, the clutch element crawls up the externally threaded surface on the floating member in the direction of the compressible packing and the fixed nut. Movement of the clutch element in the direction of the fixed nut compresses the packing and forms a fluid-tight seal with the well conduit inner bore.

7 Claims, 4 Drawing Figures

THERMAL SLIDE JOINT

BACKGROUND OF THE INVENTION

1. Field of the Invention

This invention relates to seal structures and methods for sealing between the outer cylindrical surface of a floating member and the inner bore of a surrounding conduit in a well bore.

2. Background Information

It is often desirable in well bore operations to provide a seal between a floating member and the surrounding conduit in a well bore. For instance, the floating member could be part of a thermal expansion joint in a thermal well. The floating member could also be a locator type seal assembly in a traditional permanent packer installed within a well bore. Other so-called "slide joints" are used to space out connecting strings between multi-string packets.

The seal structure of the present invention has particular advantages in thermal well environments. By "thermal well" is meant a well having a bottom hole temperature in excess of about 400 degrees Fahrenheit. Where downhole equipment is subject to high temperatures, such as in thermal wells, it is desirable for the tubing string extending to the well surface to be movable longitudinally relative to the outer packer which is sealed and anchored to the surrounding well conduit, without unseating the packer. This longitudinal movement allows for contraction and expansion of the tubing string due to temperature changes in the well bore.

In the thermal well environment, it is often necessary to provide a seal material for sealing between the slide joint and the surrounding well conduit which is made from a material other than a traditional elastomer. For instance, suitable seal or packing materials are known which are comprised of asbestos or synthetic polymers. In order to run a packing or seal of such a material into the bore of the surrounding well conduit, it is desirable to have less than an interference fit during insertion. It is then desirable to energize the seal in some manner to provide a fluid tight seal between the exterior of the floating member and the inner bore of the surrounding conduit.

SUMMARY OF THE INVENTION

The object of this invention is to provide an improved device and method for sealing a floating member within the inner bore of a surrounding well conduit. The floating member of the device is cylindrically shaped and has an outer threaded surface at the lower extent thereof for engaging an internally threaded make-up nut. A circumferential, compressible packing is sandwiched between a fixed nut, at one end, and the upper end of the threaded make-up nut. The make-up nut includes a downwardly extending clutch portion which is engageable within mating recesses provided within the inner bore of the surrounding well conduit when the floating member is run into position.

The floating member is run into position within the bore of the surrounding conduit with little or no interference fit between the compressible packing on the floating member exterior and the inner bore of the conduit. Once the clutch portion of the make-up nut is engaged within the mating recesses provided within the conduit bore, the floating member is rotated by rotating the associated tubing string which extends to the well surface. As the floating member is rotated, the make-up nut crawls up the externally threaded surface on the floating member in the direction of the compressible packing and the fixed nut. Movement of the make-up nut in the direction of the fixed nut compresses the packing and forms a fluid-tight seal with the well conduit inner bore.

Preferably the compressible packing is a non-elastomeric, thermal packing which requires some type of energization to form a seal with the well conduit inner bore. A body lock ring can also be provided between a portion of the make-up nut interior and the exterior of the floating member to lock the compressible packing in the set, energized position.

DESCRIPTION OF THE PREFERRED EMBODIMENT

Figure 1:
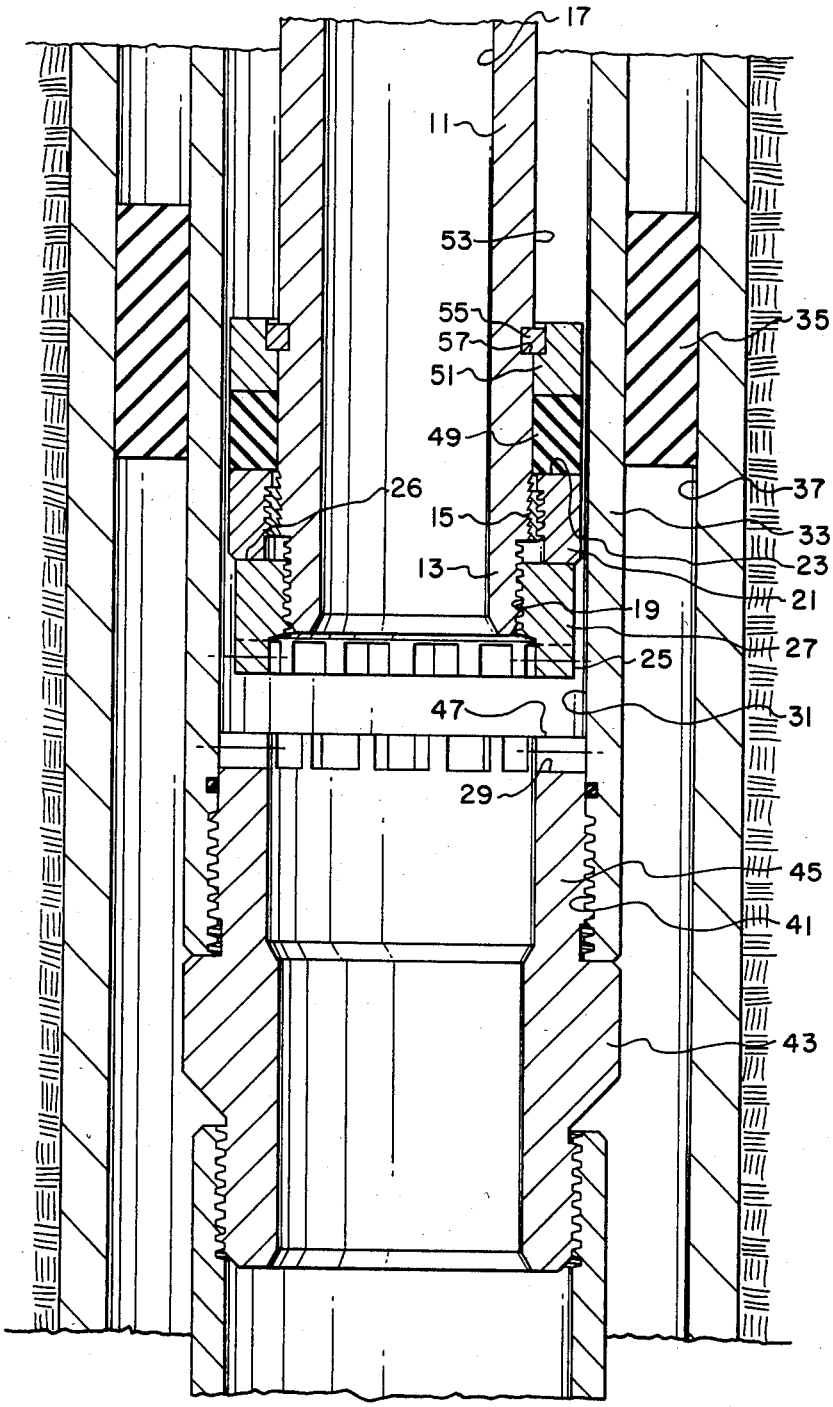
FIG. 1 is a side, cross-sectional view of a slide joint of the invention showing the floating member being inserted within the inner bore of a surrounding conduit.
Figure 2:
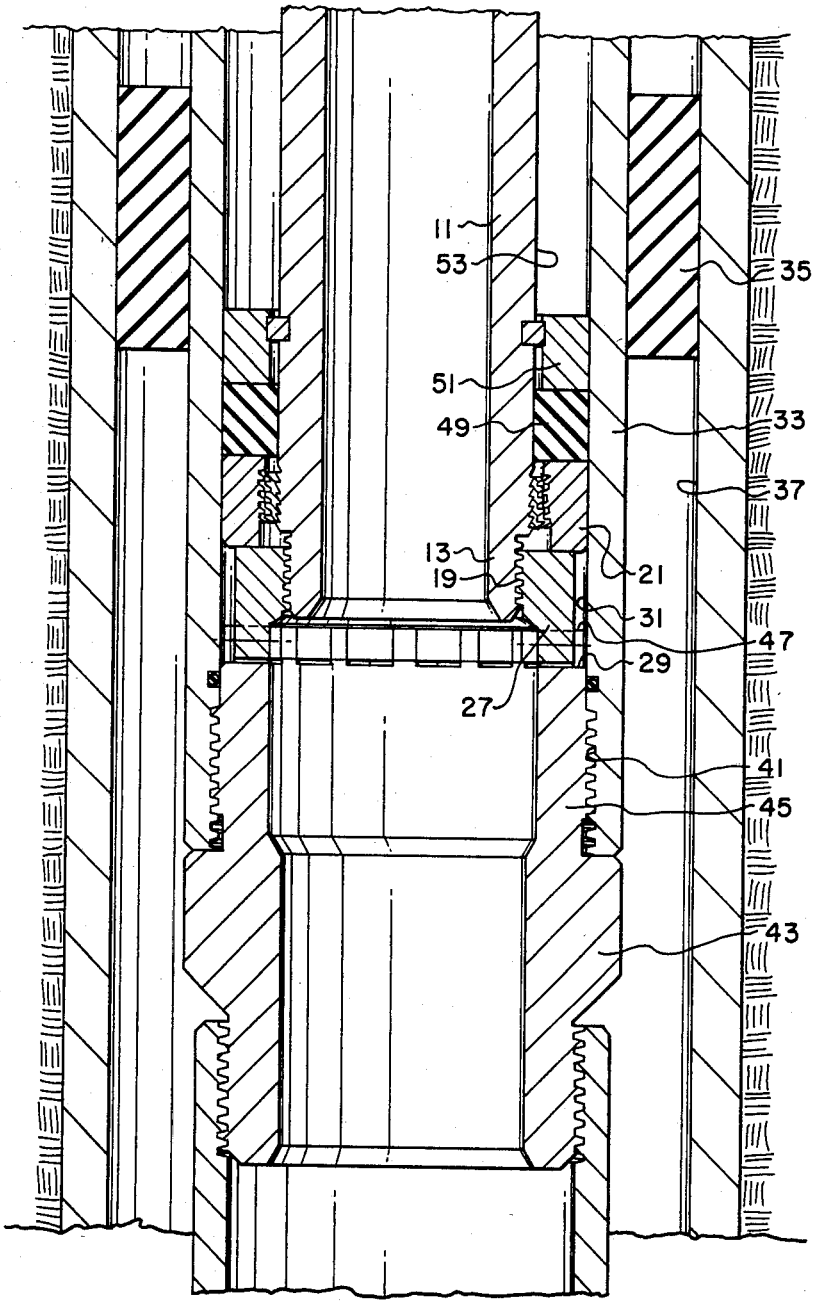
FIG. 2 is a side, cross-sectional view of the slide joint of FIG. 1 showing the floating member engaged within the bore of the surrounding conduit.
Figure 3:
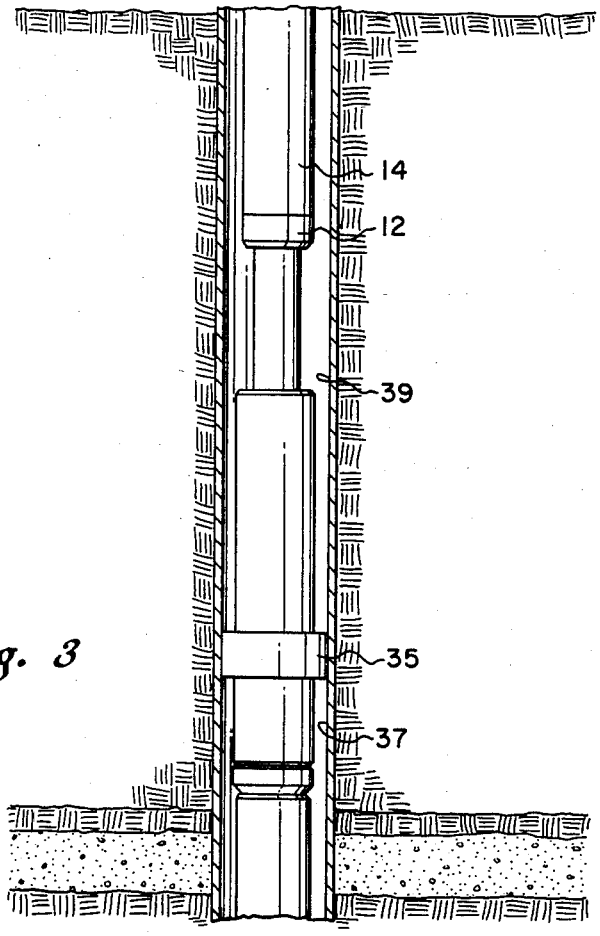
FIG. 3 is a perspective view of a slide joint of the invention installed within the bore of a permanent packer which is set within a well bore.

With reference to FIG. 1 of the drawings, the numeral 11 represents a floating member of the slide joint of the invention, such as a tubing member of the type adapted to be made-up in a well tubing string extending to the well surface. The floating member 11 is cylindrically shaped and has an upper connecting end (12 in FIG. 3) for connection into the tubing string 14 extending to the well surface and a lower extent (13 in FIG. 1) having an outer threaded surface 15. The floating member 11 also has an interior bore 17 which communicates with the interior bore of the remainder of the well tubing string running to the well surface. The floating member 11 is shown being inserted into the inner bore 31 of a surrounding well conduit 33.

The outer threaded surface 15 of the floating member 11 is adapted to threadedly engage the mating internally threaded surface 19 of a clutch element 27. Clutch element 27 supports a, generally cylindrical make-up nut 21 at one end thereof on a bearing surface 26. Clutch element 27 also has a plurality of downwardly extending clutch portions 25 which are adapted to engage mating notches 29 provided in the inner bore 31 of surrounding well conduit 33.

Surrounding conduit 33 is shown to be a permanent packer of the known type having an annular seal 35 for sealing off the well annulus 37, below the annular seal 35, from the well annulus 39 (FIG. 3) above the annular seal. It should be understood that the slide joint of the invention could also be used to provide a sliding seal within the inner bore of other types of surrounding well conduits. For instance, the slide joint could be used for spacing out connecting strings between multi-string packers or in any environment where it is desirable to provide for tubing expansion and contraction due to temperature changes within the well bore.

As shown in FIG. 1, the surrounding well conduit 33 has a lower threaded extent 41 for engaging a lower sub 43, which can support a depending pipe string 44. The lower sub 43 has an upper, cylindrical end 45 having a lip region 47. The notches 29 are circumferentially spaced about the lip region 47 of lower sub 43 within the inner bore of the surrounding conduit 33. It should be understood that the notches 29 could have also been provided by appropriately machining the interior of the conduit 33 if it was desirable to eliminate a separate lower sub 43.

A circumferential, compressible packing ring 49 is sandwiched between a fixed nut 51 and the upper portion 23 of the make-up nut 21 on the exterior surface 53 of the floating member 11. The packing ring 49 is preferably a non-elastomeric, heat resistant material, such as asbestos. Such materials are typically not "resilient" in the sense of traditional rubber elastomers and require some type of setting force to actuate the seal. As shown in FIG. 1, the packing ring 49 is not in contact with inner bore 31 during the running-in operation. A square wire 55 received within a groove 57 on the exterior surface 53 retains the fixed nut 51 in position, so that axial movement of the make-up nut 21 in the direction of the fixed nut 51 serves to compress and "energize" the packing ring 49.

Figure 4:
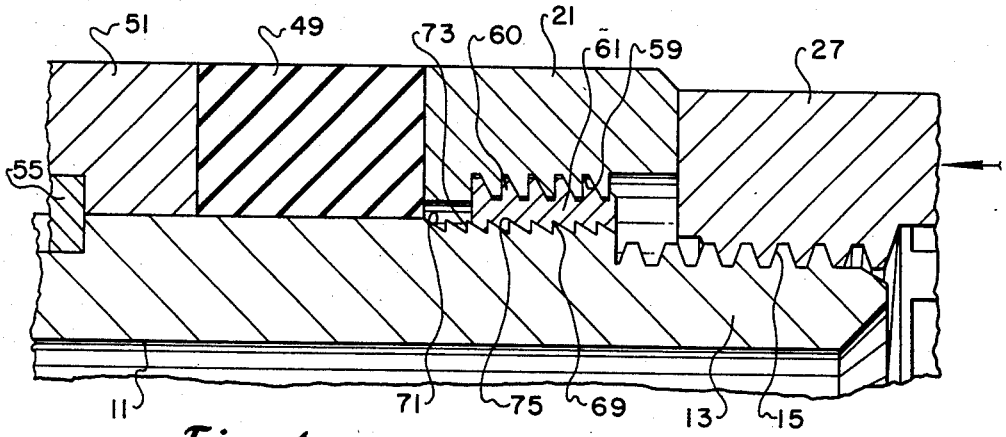
FIG. 4 is a close-up, isolated view showing the operation of the body lock ring and make-up nut of the slide joint of FIG. 1.

FIG. 4 shows a close-up view of the setting action of the clutch element 27, make-up nut 21 and the packing ring 49. The make-up nut 21 is provided with an internal recesses 59 for receiving the external teeth 60 of body lock ring 61. Rotational movement of the clutch element 27 causes the clutch element to travel up the outer threaded surface 15 of the floating member 11 and causes the make-up nut 21 to be moved axially in the direction of the packing ring 49. The make-up nut 21 thus travels axially toward the packing ring 49 but does not rotate relative to the floating member 11.

The threaded surface of the floating member 11 includes a series of fine pitched, axially spaced teeth 69 which are generally radially inwardly projecting. The teeth 69 include first flank portions 71 formed at an acute angle with respect to the longitudinal axis of the floating member 11, and a second flank portion 73 disposed at almost a right angle to the longitudinal axis. The teeth 69 are adapted to be engaged by cooperating axially spaced teeth 75 formed on the inner cylindrical surface of the body lock ring 61. The body lock ring 61 is also provided with an axial slot (not shown) extending the length of the ring to permit generally radially inward constriction of the ring when the ring is forced to move axially in one direction with respect to the teeth 69 on the floating member 11. The arrangement of the cooperating teeth and the orientation of the flank portions allows movement of the lock ring 61 and make-up nut 21 in the direction of packing ring 49, but prevents movement of the make-up nut 21 relative to the packing ring 49 in the opposite direction.

The operation of the slide joint of the invention will now be described. The slide joint is run into position within the well bore in the condition shown in FIG. 1. In this condition, the packing ring 49 is relaxed and little or no interference fit exists between the packing ring 49 and the inner bore 31 of the surrounding conduit 33. The tubing string is then set down from the surface on the lip region 47 of the lower sub 43 and the tubing string is rotated, if necessary, to engage the clutch portions 27 within the notches 29. The tubing string is then rotated to the right from the well surface to cause the clutch element 27 to travel up the outer threaded surface 15 of the floating member 11. Movement of the clutch element 27 in the direction of the fixed nut 51 compresses the packing ring 49, as has been described. Once the packing ring 49 has been "set", the floating member 11 can be stroked longitudinally within the inner bore 31 without losing the seal between the floating member 11 and the surrounding conduit 33.

An invention has been provided with several advantages. The slide joint of the invention is simple in design and reliable in operation. The slide joint is especially suited for use in thermal wells where non-elastomeric, thermal packing is needed to withstand the temperatures encountered. The thermal packing can be inserted into the bore of the surrounding conduit without sliding the packing against the inner bore of the conduit, thereby avoiding damage to the packing. The packing can then be set or energized to provide a sure and effective seal with the inner bore of the conduit. The resulting slide joint can travel longitudinally within the bore of the surrounding conduit to accommodate expansion and contraction of the tubing string without losing the seal.

While the invention has been shown in only its preferred form, it should be apparent to those skilled in the art that it is not thus limited but is susceptible to various changes and modifications without deparating from the spirit thereof.

I claim:

1. A slide joint for sealing the annular space between the outer surface of a floating tubular member and the inner bore of a surrounding conduit in a well bore, comprising:

a cylindrical floating member having upper connecting means for connection in a well tubing string extending to the well surface and an outer cylindrical surface;

a clutch element carried on said floating member, said clutch element having an upper portion and downwardly extending clutch portions;

a circumferential, compressible packing ring located on said floating member outer surface between said clutch element upper portion and a fixed nut carried on said outer surface;

and wherein said inner bore of said surrounding conduit is provided with mating recesses for receiving the clutch portions of said clutch element when said floating member is run into position within said well conduit so that rotation of said clutch element causes said clutch element to travel axially up said floating member outer surface to compress said packing ring.

2. A slide joint for sealing the annular space between the outer surface of a floating tubular member and the inner bore of a surrounding conduit in a well bore, comprising:

a cylindrical floating member having upper connecting means for connection in a well tubing string extending to the well surface and an outer threaded surface at the lower extent thereof;

an internally threaded clutch element for engaging said floating member outer threaded surface, said clutch element having a plurality of downwardly extending clutch portions;

a make-up nut which is supported at one extent upon said clutch element by a bearing surface thereof;

a body lock ring located on an interior surface of said make-up nut, said body lock ring being engaged within recesses provided in said interior surface, whereby movement of said make-up nut on said floating member threaded surface causes said body lock ring to travel up said floating member threaded surface;

a circumferential, compressible packing ring located on said floating member outer surface between said make-up nut and a fixed nut carried on said outer surface;

and wherein said inner bore of said surrounding conduit is provided with mating recesses for receiving the clutch portions of said clutch element when said floating member is run into position within said well conduit so that rotation of said clutch element causes said make-up nut to move axially up said floating member threaded surface to compress said packing ring.

3. A slide joint for sealing the annular space between the outer surface of a floating tubular member and the inner bore of a surrounding conduit in a well bore, comprising:

a cylindrical floating member having upper connecting means for connection in a well tubing string extending to the well surface and an outer threaded surface at the lower extent thereof;

an internally threaded clutch element for engaging said floating member outer threaded surface, said clutch element having a plurality of downwardly extending clutch portions, a make-up nut which is supported at one extent upon said clutch element by a bearing surface thereof;

a body lock ring located on an interior surface of said make-up nut, said body lock ring being engaged within a recess provided in said interior surface whereby movement of said make-up nut on said floating member threaded surface causes said body lock ring to travel up said floating member threaded surface and wherein said body lock ring and said floating member threaded surface are provided with cooperating teeth which permit movement of said make-up nut in one direction with respect to said floating member but which prevent movement of said make-up nut in the opposite relative direction;

a circumferential, non-elastomeric, compressible packing ring located on said floating member outer surface between said make-up nut and a fixed nut carried on said outer surface; and wherein said inner bore of said surrounding conduit is provided with mating recesses for receiving the clutch portions of said clutch element when said floating member is run into position within said well conduit so that rotation of said clutch element causes said make-up nut to move up said floating member threaded surface to compress said packing ring.

4. The slide joint of claim 3, wherein said non-elastomeric packing is a thermal packing material usable at well bore temperatures in the range of 400 degrees Farenheit and upwards.

5. The slide joint of claim 3, wherein said mating recesses provided in the inner bore of said surrounding conduit are provided in a separate sub which is threadedly engaged on the lower extent of said surrounding conduit.

6. A method of sealing a floating member within the inner bore of a surrounding well conduit, comprising the steps of:

providing a floating, cylindrical member having an outer threaded surface at the lower extent thereof;

engaging a fixed nut on a portion of the outer surface of said floating member above said lower extent;

providing a compressible packing ring below said fixed nut on said outer surface;

engaging a make-up nut on said outer threaded surface of said floating member whereby said packing ring is sandwiched between said make-up nut and said fixed nut;

engaging a clutch element on the outer threaded surface of said floating member below said make-up nut, said clutch element being provided with downwardly extending clutch portions for engaging mating recesses provided within said surrounding well conduit;

running said floating member into the inner bore of said surrounding well conduit on a tubing string until the clutch portions of said clutch element engage said well conduit recesses;

rotating said floating member by rotating said tubing string to thereby move said clutch element up said floating member threaded surface in the direction of said make-up nut to compress said packing and form a fluid-tight seal with the well conduit inner bore.

7. The method of claim 6, further including the steps of allowing longitudinal movement of the tubing string with respect to the inner bore of said well conduit.

* * * * *